US008191805B2

(12) United States Patent
Nakada et al.

(10) Patent No.: US 8,191,805 B2
(45) Date of Patent: Jun. 5, 2012

(54) ELECTROSTATIC ATOMIZER

(75) Inventors: Takayuki Nakada, Hikone (JP); Hiroshi Suda, Takatsuki (JP); Masaharu Machi, Shijonawate (JP); Tomohiro Yamaguchi, Moriyama (JP); Sumio Wada, Hikone (JP)

(73) Assignee: Panasonic Corporation, Osaka (JP)

( * ) Notice: Subject to any disclaimer, the term of this patent is extended or adjusted under 35 U.S.C. 154(b) by 469 days.

(21) Appl. No.: 12/519,401

(22) PCT Filed: Dec. 18, 2007

(86) PCT No.: PCT/JP2007/074774
§ 371 (c)(1),
(2), (4) Date: Jun. 16, 2009

(87) PCT Pub. No.: WO2008/081764
PCT Pub. Date: Jul. 10, 2008

(65) Prior Publication Data

US 2010/0044475 A1 Feb. 25, 2010

(30) Foreign Application Priority Data

Dec. 22, 2006 (JP) ..... 2006-346544

(51) Int. Cl.
*B05B 5/00* (2006.01)

(52) U.S. Cl. ..... 239/690; 239/128; 239/132; 239/133; 62/129; 62/135

(58) Field of Classification Search ..... 239/3, 690, 239/690.1, 128, 132, 133, 135; 62/129, 135
See application file for complete search history.

(56) References Cited

U.S. PATENT DOCUMENTS

| | | | | |
|---|---|---|---|---|
| 5,337,963 | A | 8/1994 | Noakes | |
| 7,874,503 | B2 * | 1/2011 | Imahori et al. | 239/128 |
| 2006/0064892 | A1 | 3/2006 | Matsui et al. | |

(Continued)

FOREIGN PATENT DOCUMENTS

| | | |
|---|---|---|
| EP | 0486198 | 5/1992 |

(Continued)

OTHER PUBLICATIONS

Japanese Final Office Action, dated Sep. 21, 2010. (English Abstact of Japanese Final Office Action provided.).

(Continued)

*Primary Examiner* — Steven J Ganey
(74) *Attorney, Agent, or Firm* — Greenblum & Bernstein, P.L.C.

(57) ABSTRACT

Disclosed is an electrostatic atomizer, which comprises a cooler adapted to cool an atomizing electrode so as to allow moisture in air to be frozen onto the atomizing electrode, a melter adapted to melt ice frozen on the atomizing electrode so as to supply water onto the atomizing electrode, a high-voltage applying section adapted to apply a high voltage to the atomizing electrode, and a control section adapted to activate the high-voltage applying section in a state after supplying water onto the atomizing electrode by melting the ice frozen thereon, so as to apply a high voltage to the atomizing electrode to electrostatically atomize the water supplied on the atomizing electrode. The electrostatic atomizer of the present invention can reliably supply water onto the atomizing electrode and electrostatically atomize the water, without restrictions due to temperature/humidity conditions in a mist-receiving space targeted for implementation of electrostatic atomization therewithin, even if the mist-receiving space has a low temperature and/or a low humidity.

7 Claims, 10 Drawing Sheets

U.S. PATENT DOCUMENTS

| | | | | |
|---|---|---|---|---|
| 2006/0131449 | A1* | 6/2006 | Azukizawa et al. | 239/690 |
| 2009/0078800 | A1 | 3/2009 | Nakasone et al. | |

FOREIGN PATENT DOCUMENTS

| | | |
|---|---|---|
| EP | 1733798 | 12/2006 |
| JP | 3260150 | 12/2001 |
| JP | 2005-296753 | 10/2005 |
| JP | 2006-68711 | 3/2006 |
| JP | 2006-150334 | 6/2006 |
| JP | 2008-101817 | 5/2008 |
| WO | 2006/009189 | 1/2006 |
| WO | 2006/009190 | 1/2006 |

OTHER PUBLICATIONS

English language Abstract of JP 2006-68711, Mar. 16, 2006.
English language Abstract of JP 3260150, Dec. 14, 2001.

* cited by examiner

ELECTROSTATIC ATOMIZER

TECHNICAL FIELD

The present invention relates to an electrostatic atomizer designed to generate nanometer-size charged fine water droplets by means of an electrostatic atomization phenomenon and supply the charged fine water droplets to a mist-receiving space.

BACKGROUND ART

There has been proposed an electrostatic atomizer comprising an atomizing electrode, a counter electrode disposed in opposed relation to the atomizing electrode, and a water supplier for supplying water onto the atomizing electrode, wherein a high-voltage is applied between the atomizing electrode and the counter electrode to atomize water held on the atomizing electrode so as to generate charged fine water droplets each having a nanometer size and carrying a large number of electric charges (i.e., nanometer-size charged mist droplets), as disclosed in the following Patent Publication 1.

The nanometer-size charged water droplets have not only a moisturizing effect, but also a deodorizing effect, a sterilization effect on molds and bacteria, and a suppressive effect on propagation thereof, based on active species existing therein in a state of being wrapped with water molecules. The nanometer-size charged water droplets are as small as a manometer in size and thereby exhibit high floatability on air and high dispersion performance. In addition, the active species exist in the nanometer-size charged water droplets in the state of being wrapped with water molecules and thereby exhibit a longer life as compared with active species existing independently in the form of a free radical. Thus, the nanometer-size charged water droplets have a feature of being able to drift in air for a long period of time evenly and broadly so as to provide enhanced moisturizing effect, deodorizing effect, etc.

In the conventional electrostatic atomizer disclosed in the Patent Publication 1, the water supplier for supplying water onto the atomizing electrode comprises a water tank adapted to be filled with water, and a water transport section adapted to transport water stored in the water tank to the atomizing electrode by means of a capillary phenomenon. This type of water supplier requires a user to refill the water tank with water on a regular basis. That is, a user is obliged to spend time and effort for the cumbersome water-refilling operation, which leads to a problem about poor usability. Moreover, in the conventional electrostatic atomizer, if water containing an impurity, such as Ca or Mg, typically tap water, is used as the supply water, the impurity will cause a problem that it reacts with $CO_2$ in air to form a deposit (i.e., reaction product), such as $CaCO_3$ or MgO, on an end of the water transport section, and the deposit blocks the capillarity-based water supply to hinder the generation of nanometer-size charged water droplets.

A technique intended to solve the above problems has been proposed in the following Patent Publication 2. Specifically, the Patent Publication 2 discloses an electrostatic atomizer which comprises a Peltier unit having a cooling section thermally connected to an atomizing electrode to cool the atomizing electrode, wherein water is supplied onto the atomizing electrode by cooling the atomizing electrode using the cooling section to induce condensation of moisture in air, and a high voltage is applied between the atomizing electrode and a counter electrode to electrostatically atomize the water (condensation water) supplied onto the atomizing electrode.

The conventional electrostatic atomizer disclosed in the Patent Publication 2 has a feature of being able to eliminate the need for the aforementioned water-refilling operation, and avoid the formation of the deposit, such as $CaCO_3$ or MgO, because no impurity is contained in water obtained through the condensation.

The conventional electrostatic atomizer disclosed in the Patent Publication 2 is designed to continuously apply a high voltage to the atomizing electrode while continuously supplying water onto the atomizing electrode by continuously cooling the atomizing electrode using the cooling section of the Peltier unit to induce condensation of moisture in air, so that a condensation-water supply process and an electrostatic atomization process are performed in a simultaneous parallel, i.e., concurrent, manner. In this conventional electrostatic atomizer, if the atomizing electrode is cooled down to 0 (zero)° C. or less, moisture in air will be frozen and attached onto the atomizing electrode in the form of frozen water (i.e., ice) which cannot be electrostatically atomized even if a high voltage is applied to the atomizing electrode. That is, the conventional electrostatic atomizer has the need for cooling the atomizing electrode while avoiding freezing of moisture in air. For meeting this requirement, the Peltier unit is designed to keep the atomizing electrode from being cooled down to 0° C. or less. This means that an allowable lower limit of a cooling temperature for the atomizing electrode is a positive value close to 0° C.

Consequently, under a condition that a mist-receiving space targeted for implementation of electrostatic atomization therewithin has a low humidity, a problem will occur that, even if the atomizing electrode is cooled down to a temperature close to 0° C., moisture in air does not reach a saturated state, which precludes condensation water from being produced. Particularly, under a condition that the mist-receiving space has a temperature of 0° C. or more but close to 0° C., even if the atomizing electrode is cooled down to 0° C., a difference between respective temperatures of the mist-receiving space and the atomizing electrode is small, and thereby any condensation water cannot be produced, except that the mist-receiving space has a relatively high humidity.

FIG. 10 is a graph showing an atomizable zone determined by a relationship of a temperature of the mist-receiving space, a humidity of the mist-receiving space and a setup temperature of the atomizing electrode. In FIG. 10, an atomizable zone in the conventional electrostatic atomizer is located above a curve for a setup temperature of 0° C. (i.e., a specific zone on an upper side relative to the thick curve in FIG. 10), and electrostatic atomization can be induced only in the specific region. As seen in FIG. 10, the conventional electrostatic atomizer has a problem that an environment for electrostatic atomization is largely restricted by temperature/humidity conditions in a mist-receiving space targeted for implementation of electrostatic atomization therewithin, to cause difficulty in utilizing the electrostatic atomizer in low-humidity and/or low-temperature environments, i.e., humidity/temperature environments allowing for utilization of the electrostatic atomizer are limited to a narrow range.

[Patent Publication 1] Japanese Patent No. 3260150

[Patent Publication 2] Japanese Unexamined Patent Publication No. 2006-68711

DISCLOSURE OF THE INVENTION

In view of the above conventional problems, it is an object of the present invention to provide an electrostatic atomizer which can reliably supply water onto an atomizing electrode to electrostatically atomize the water in a stable manner, without restrictions due to temperature/humidity conditions in a mist-receiving space targeted for implementation of electrostatic atomization therewithin, even if the mist-receiving space has a low temperature and/or a low humidity.

In order to achieve the above object, the present invention provides an electrostatic atomizer which comprises an atomizing electrode adapted to be controlled to electrostatically atomize water attached thereon, a cooler adapted to cool the atomizing electrode so as to allow moisture in air to be frozen onto the atomizing electrode, a melter adapted to melt ice frozen on the atomizing electrode so as to supply water onto the atomizing electrode, a high-voltage applying section adapted to apply a high voltage to the atomizing electrode, and a control section adapted to activate the high-voltage applying section in a state after supplying water onto the atomizing electrode by melting the ice frozen thereon, so as to induce electrostatic atomization of the water.

In the electrostatic atomizer of the present invention, the cooler is operable to cool the atomizing electrode down to 0 (zero)° C. or less so as to allow moisture in air to be frozen and attached onto the atomizing electrode in the form of ice, and then the melter is operable to melt the ice frozen and attached on the atomizing electrode so as to supply the melted water onto the atomizing electrode. Then, the high-voltage applying section is operable to apply a high voltage to the atomizing electrode so as to induce electrostatic atomization of the water supplied onto the atomizing electrode. In this manner, moisture in air is frozen into ice once, and then the ice is melted and supplied in the form of water. Thus, even if a mist-receiving space targeted for implementation of electrostatic atomization therewithin has a low humidity and/or a low temperature, water can be reliably supplied onto the atomizing electrode and electrostatically atomized to stably produce charged fine water droplets.

As above, the electrostatic atomizer of the present invention is designed to electrostatically atomize water which is supplied onto the atomizing electrode in such a manner that moisture in air of the mist-receiving space is frozen onto the atomizing electrode, and then the ice frozen on the atomizing electrode is melted. Thus, the electrostatic atomizer can reliably supply water onto the atomizing electrode to electrostatically atomize the water in a stable manner, without restrictions due to temperature/humidity conditions in a mist-receiving space targeted for implementation of electrostatic atomization therewithin, even if the mist-receiving space has a low temperature and/or a low humidity. This makes it possible to effectively expand an atomizable zone so as to utilize the electrostatic atomizer in a broader range of humidity/temperature environments.

BRIEF DESCRIPTION OF DRAWINGS

FIGS. 5A to 5D are explanatory diagrams showing the control operation in FIG. 4, wherein FIGS. 5A, 5B, 5C and 5D illustrate a state after ice is attached onto an atomizing electrode of the electrostatic atomizer shown in FIG. 1, a state after the ice is melted into water, a state when electrostatic atomization is performed, and a state after the electrostatic atomization is terminated.

BEST MODE FOR CARRYING OUT THE INVENTION

The present invention will now be described based on an embodiment thereof illustrated in accompanying drawings.

With reference to FIGS. 1 to 6, a first embodiment of the present invention will be described below. An electrostatic atomizer according the first embodiment is intended to be applied to an apparatus A having a mist-receiving space 9, and a cold space 13 which is located adjacent to the mist-receiving space 9 and maintained at a temperature less than that of the mist-receiving space 9. The electrostatic atomizer is designed to produce nanometer-size fine water droplets (i.e., mist) through electrostatic atomization, and supply the mist to the mist-receiving space 9.

For example, the apparatus A having the mist-receiving space 9 and the cold space 13 may include a refrigerator and an air-conditioner.

Although the first embodiment will be described by taking a refrigerator A1 as one example of the apparatus A having the mist-receiving space 9 and the cold space 13, an apparatus suitable for applying the present invention is not limited to the refrigerator A1.

Figure 3:
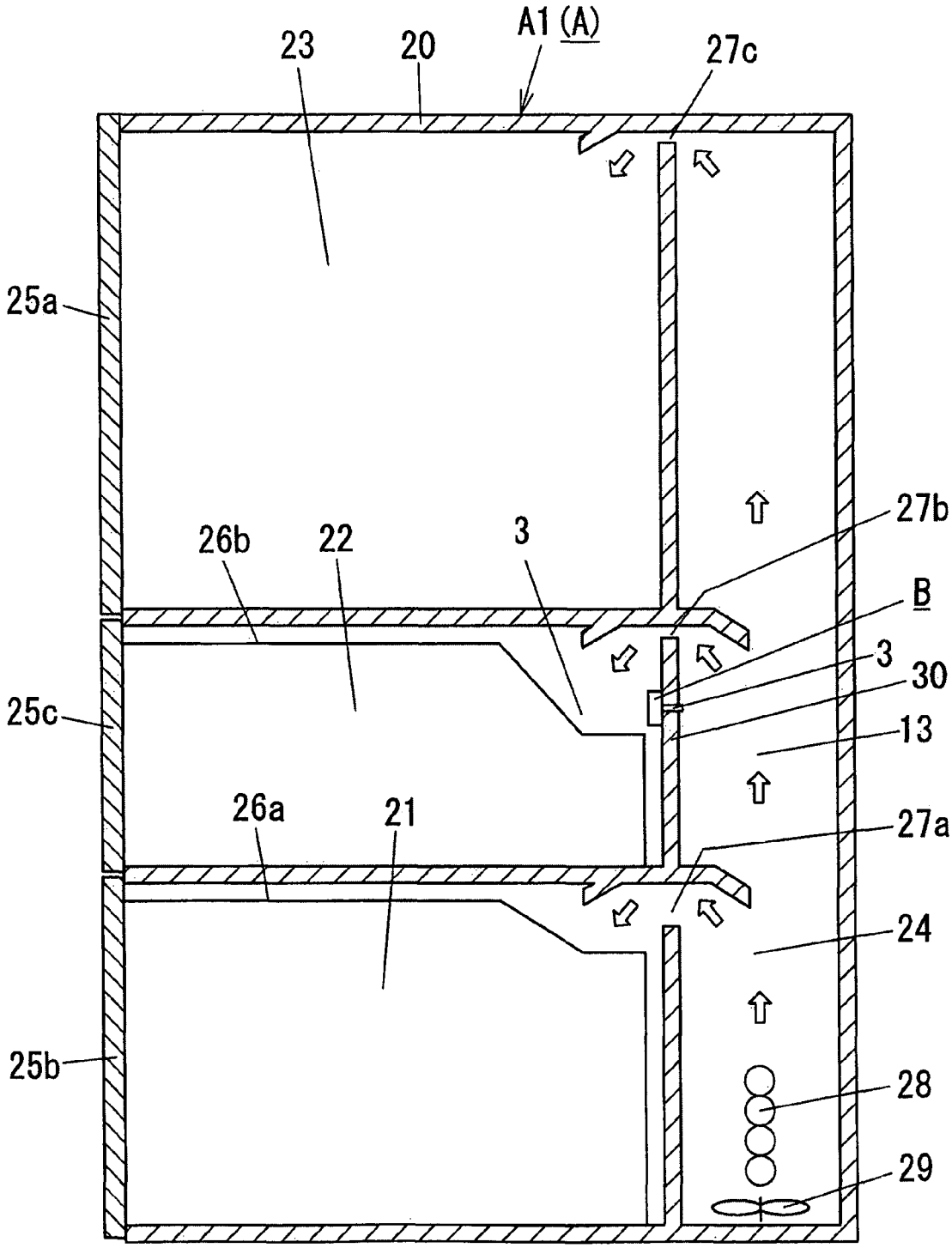
FIG. 3 is a sectional view showing one example where the electrostatic atomizer shown in FIG. 1 is used in a refrigerator.

FIG. 3 is a schematic diagram showing an internal structure of the refrigerator A1. In FIG. 3, the refrigerator A1 comprises a refrigerator housing 20 which is internally provided with a freezing compartment 21, a vegetable compartment 22, a cooling compartment 23 and a cold-air passage 24. In an outer shell of the refrigerator housing 20, each of the freezing compartment 21, the vegetable compartment 22, the cooling compartment 23 and the cold-air passage 24 is divided by a partition wall 30. The partition wall 30 is made of a heat-insulating material, and formed with a through-hole 30*b* (see FIG. 1). Further, an outer skin 30*a* (see FIG. 1) formed of a synthetic-resin molded product is integrally laminated on a surface of the partition wall 30. Portions of the partition wall 30 dividing between the cold-air passage 24 and respective ones of the freezing compartment 21, the vegetable compartment 22 and the cooling compartment 23 are formed, respectively, with communication holes 27*a*, 27*b*, 27*c* for providing fluid communication between the cold-air passage 24 and respective ones of the freezing compartment 21, the vegetable compartment 22 and the cooling compartment 23.

Each of the freezing compartment 21, the vegetable compartment 22 and the cooling compartment 23 has an opening on a front side (in FIG. 3, left side) of the refrigerator A1. The front opening of the cooling compartment 23 is provided with a door 25*a* attached thereto through a hinge in a swingably openable and closable manner. The freezing compartment 21 and the vegetable compartment 22 are provided, respectively, with drawer-type boxes 26*a*, 26*b* in an extractable and insertable manner. The drawer-type boxes 26*a*, 26*b* are integrally formed, respectively, with doors 25*b*, 25*c* at respective front ends thereof. Specifically, each of the drawer-type boxes 26*a*, 26*b* is adapted, when it is fully inserted and received into/in a corresponding one of the freezing compartment 21 and the vegetable compartment 22, to close the front opening of the corresponding one of the freezing compartment 21 and the vegetable compartment 22 by the door (26*a*, 26*a*) formed at the front end of the drawer-type box (26*a*, 26*b*).

The cold-air passage 24 is internally provided with a cooling source 28 and a fan 29. The cooling source 29 is operable to cool air in the cold-air passage 24 (e.g., cool the air down to about −20° C.), and the fan 29 is operable to supply the cooled air in the cold-air passage 24 to each of the freezing compartment 21, the vegetable compartment 22 and the cooling compartment 23 through a corresponding one of the communication holes 27*a*, 27*b*, 27*c*. Each of the freezing compartment 21, the vegetable compartment 22 and the cooling compartment 23 is set at a desired temperature according to the cooled air supplied thereto. More specifically, each of the desired temperatures of the vegetable compartment 22 and the cooling compartment 23 is greater than the desired temperature of the freezing compartment 21 (e.g., the desired temperature of the vegetable compartment 22 is set at about 5° C.). Thus, each of the communication holes 27*b*, 27*c* is formed to have an opening area less than that of the communication hole 27*a* so as to reduce a volume of cooled air from the cold-air passage into each of the vegetable compartment 22 and the cooling compartment 23, as compared with the freezing compartment 21.

Although not illustrated, each of the freezing compartment 21, the vegetable compartment 22 and the cooling compartment 23 is provided with a return passage for returning air to an upstream side of the cold-air passage 24 relative to the cooling source 28.

For example, in the above refrigerator A1, the vegetable compartment 22 and/or the cooling compartment 23 serve as the mist-receiving space 9, and the cold-air passage 24 located adjacent to the vegetable compartment 22 and the cooling compartment 23 through the partition wall 30 made of a heat-insulating material serves as the cold space 13 having a temperature less than that of the mist-receiving space 9 (in FIG. 3, the vegetable compartment 22 serves as the mist-receiving space 9). The cold space 13 in the first embodiment is a space having a temperature of 0 (zero)° C. or less. For example, when the cold space 13 is comprised of the cold-air passage 24 of the refrigerator A1 as in the first embodiment, the temperature of the cold space 13 may be set at about −20° C. as described above. It is understood that the temperature of the cold space 13 is not limited to this specific value, but may be set at any other suitable value of 0° C. or less.

A main unit B of the electrostatic atomizer (hereinafter referred to simply as "atomizer main unit B") is mounted to a surface of the portion of the partition wall 30 dividing between the vegetable compartment 22 (i.e., the mist-receiving space 9) and the cold-air passage 24 (i.e., the cold space 13), on the side of the mist-receiving space 9.

The atomizer main unit B comprises an atomizing electrode 1, a counter electrode 2, a high-voltage applying section 5 adapted to apply a high voltage between the atomizing electrode 1 and the counter electrode 2, a control section 15 adapted to control an electrostatic atomization operation, and an atomizer housing 31 receiving therein the above components.

The atomizer housing 31 is divided into a receiving chamber 16*a* receiving therein the high-voltage applying section 5 and the control section 15, and a discharge chamber 16*b*. The receiving chamber 16*a* receiving therein the high-voltage applying section 5 and the control section 15 is formed as a closed (i.e., hermetically sealed) chamber designed to prevent foreign substances, such as water, from getting thereinto from outside. The atomizing electrode 1 and the counter electrode 2 are disposed in the discharge chamber 16*b*. The counter electrode 2 is formed of a doughnut-shaped metal plate, and mounted to a portion of the discharge chamber 16*b* on the front side of the refrigerator A1 in such a manner as to be disposed inside the discharge chamber 16*b* and in opposed relation to a mist-releasing opening 17 formed in a front wall of the atomizer housing 31. The atomizing electrode 1 is mounted to a rear wall of the discharge chamber 16*b*. The atomizing electrode 1 is positioned to allow a pointed portion at a tip end thereof to be located coaxially with a center axis of a center hole of the doughnut-shaped counter electrode 2. Each of the atomizing electrode 1 and the counter electrode 2 is electrically connected to the high-voltage applying section 5 through a high-voltage lead wire.

The atomizing electrode 1 is provided with a heat transfer member 18 made of a material having excellent heat conductivity, such as metal, and located at a rear end thereof. The atomizing electrode 1 and the heat transfer member 18 may be integrally formed as a single piece. Alternatively, the heat transfer member 18 may be formed separately from the atomizing electrode 1 and then fixedly attached to the atomizing electrode 1, or the heat transfer member 18 may be formed separately from the atomizing electrode 1 and then brought into contact with the atomizing electrode 1. In either case, the atomizing electrode 1 and the heat transfer member 18 are formed in a structure which allows heat to be efficiently transferred therebetween, i.e., allows heat exchange to be efficiently performed therebetween.

Figure 1:
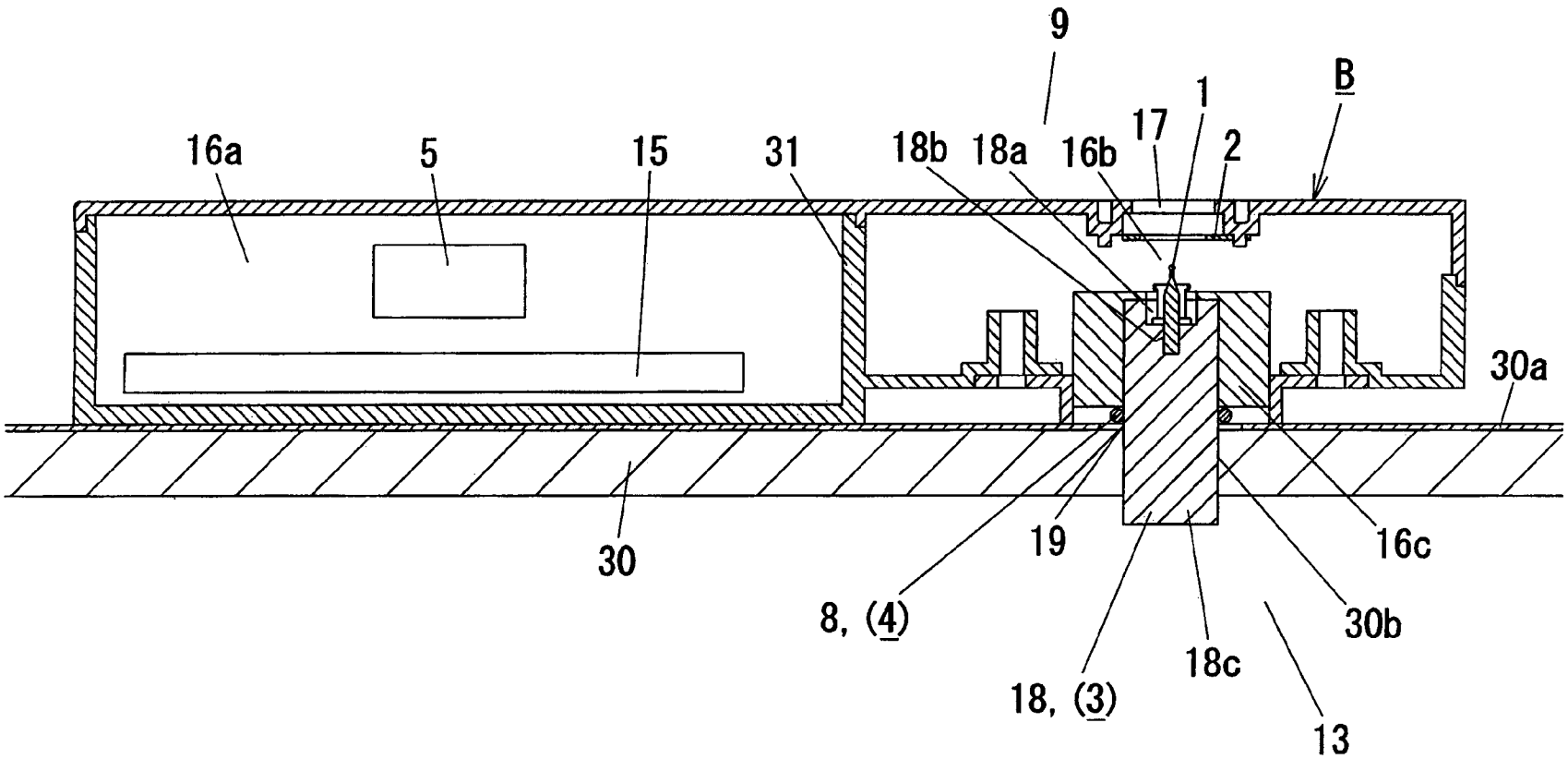
FIG. 1 is a vertical cross-sectional view showing an electrostatic atomizer according to one embodiment of the present invention.
Figure 2:
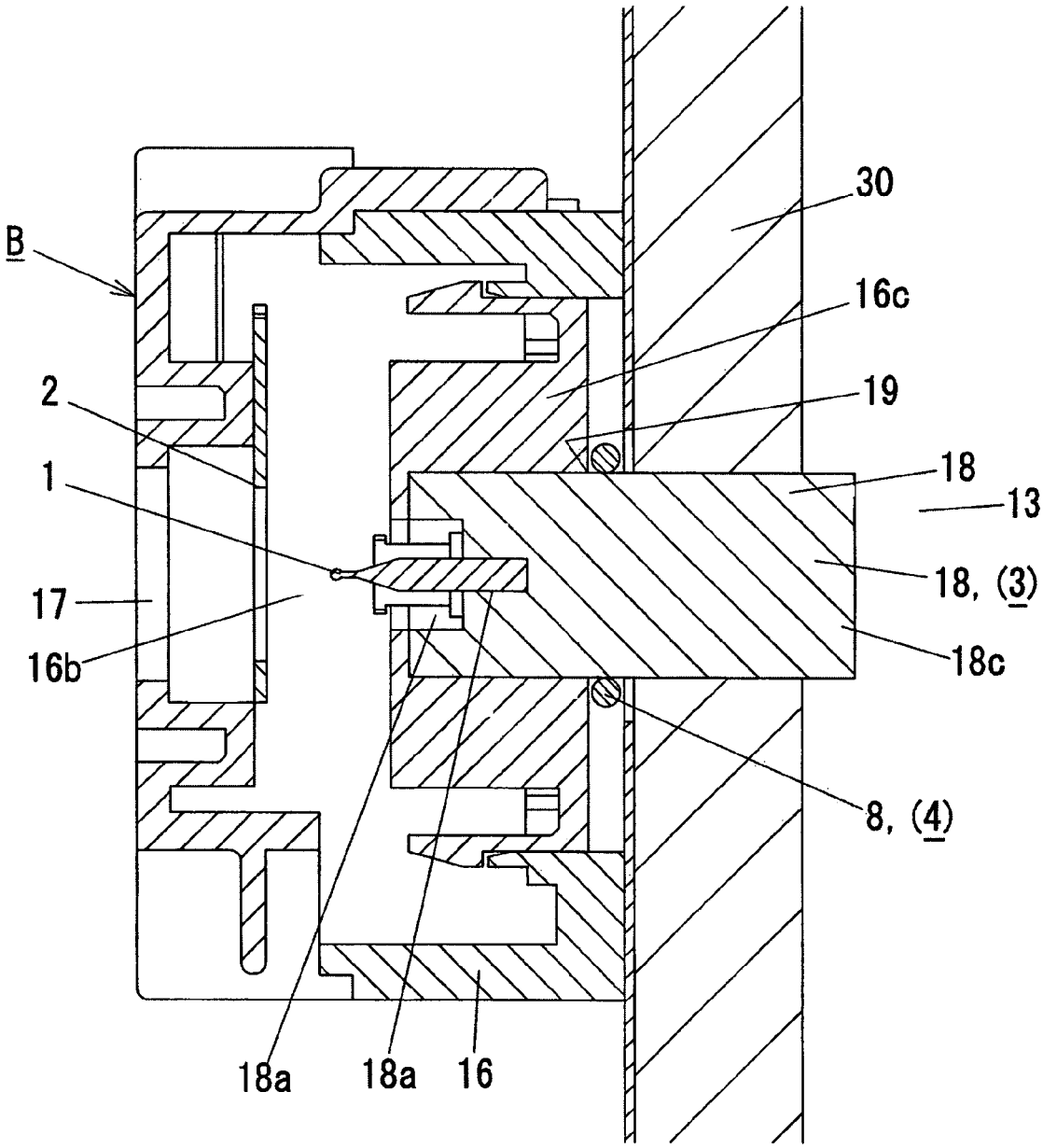
FIG. 2 is an enlarged vertical cross-sectional view showing the electrostatic atomizer shown in FIG. 1.

In the first embodiment illustrated in FIGS. 1 and 2, the heat transfer member 18 is made of metal and formed in a columnar shape. The heat transfer member 18 has a front surface formed with a concave portion 18*a* which has a bottom surface formed with a fitting hole 18*b*. The atomizing electrode 1 is formed in a rod shape, and an rear end of the atomizing electrode 1 is fitted into the fitting hole 18*b*. In this state, a front end, i.e., a tip end, of the atomizing electrode 1 protrudes frontwardly from the front surface of the heat transfer member 18. That is, the atomizing electrode 1 and the heat transfer member 18 in the first embodiment are arranged to efficiently perform heat exchange therebetween, based on heat exchange through heat radiation between an inner surface of the concave portion 18*a* and an outer surface of the atomizing electrode 1 in spaced-apart opposed relation to each other, in addition to heat exchange through heat conduction between an inner surface of the fitting hole 18*b* and the rear end of the atomizing electrode 1 in contact with each other.

The heat transfer member 18 is mounted to the atomizer housing 31 (in the first embodiment, the heat transfer member 18 is mounted to a cap member 16*c* forming a part of the rear wall of the atomizer housing 31, as shown in FIGS. 1 and 2). The rear wall of the atomizer housing 31 is formed with a hole 19 (in the first embodiment, the hole 19 is formed in the cap member 16*c*, as shown in FIGS. 1 and 2). The heat transfer member 18 is arranged to penetrate through the hole 19 and then protrude rearwardly.

The atomizer housing 31 is mounted to the front surface of the partition wall 30 facing the mist-receiving space 9 (e.g., the vegetable compartment). In this state, a protruding portion 18*c* of the heat transfer member 18 is inserted into the through-hole 30*b* of the partition wall 30 to allow a rear end of the protruding portion 18*c* to be exposed inside the cold space 13.

Thus, the protruding portion 18*c* is cooled by the cold space 13, and thereby the atomizing electrode 1 located inside the mist-receiving space 9 is cooled through the heat transfer member 18. In this process, it is ensured that the atomizing electrode 1 is cooled down to 0 (zero)° C. or less. Specifically, it is ensured that moisture in air around the atomizing electrode 1 (i.e., moisture in air of the mist-receiving space 9 having a temperature of greater than 0° C.) is frozen and attached onto the atomizing electrode 1. That is, in the first embodiment, a cooler 3 is made up of a combination of the cold space 13 maintained at a temperature of 0 (zero)° C. or less, and the heat transfer member 18, and the atomizing electrode 1 is adapted to be cooled down to 0° C. or less by the cooler 3.

Further, in the first embodiment, an electric heater 8 is disposed in adjacent relation to the atomizing electrode 1 or the heat transfer member 18 (for example, in such a manner as to surround therearound), to serve as a heater 4.

The control section 15 is designed to control a timing of supplying a current to the heater 8 serving as the heater 4, a time period of the current supply to the heater 8, a timing of activating the high-voltage applying section to apply a high voltage between the atomizing electrode 1 and the counter electrode 2, a timing of deactivating the high-voltage applying section to stop applying the high voltage, etc.

Figure 4:
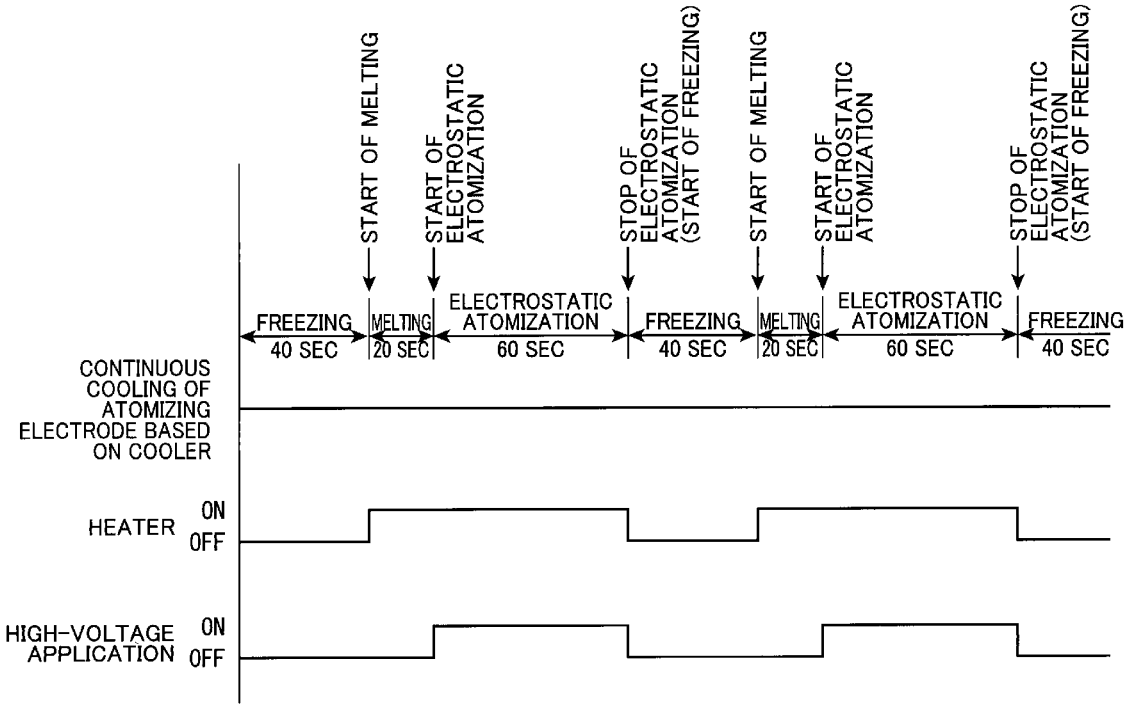
FIG. 4 is a time chart showing one example of a control operation of the electrostatic atomizer shown in FIG. 1.

In the first embodiment, as shown in the time chart illustrated in FIG. 4, under a condition that the atomizing electrode 1 is continuously cooled by the cooler 3, the controller 15 is operable to control the current supply to the heater 8 and the high-voltage application, in such a manner that a freezing process to be performed without the current supply to the heater 8 and the high-voltage application, a melting process to be performed subsequently to the freezing process and with the current supply to the heater 8 (without the high-voltage application), and an electrostatic atomization process to be performed subsequently to the melting process and with the high-voltage application (while continuing the current supply to the heater 8), are repeated in sequence. In one example illustrated in FIG. 4, a start timing of the current supply to the heater 8, a time period of the current supply to the heater 8, a timing of activating the high-voltage applying section to apply a high voltage between the atomizing electrode 1 and the counter electrode 2, and a timing of deactivating the high-voltage applying section to stop applying the high voltage, are controlled to allow time periods of the freezing process, the melting process and the electrostatic atomization process to be set at 30 seconds, 20 seconds and 60 seconds, respectively. The specific time periods of the above processes are shown only by way of example, and each of the time periods may be set at an optimal value in consideration of a temperature and a humidity of the mist-receiving space 9, a temperature of the atomizing electrode 1, a temperature of the cold space 13 and other parameter.

Figure 5A:
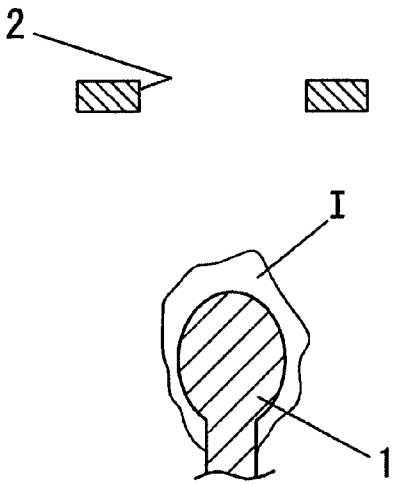

According to the above sequence, in the freezing process, the heat transfer member 18 is cooled by the cold space 13, and thereby the atomizing electrode 1 is cooled down to a certain intended temperature of 0 (zero)° C. or less, so that moisture in air of the mist-receiving space 9 is frozen and attached onto the atomizing electrode 1 in the form of ice I, as shown in FIG. 5A.

Figure 5B:
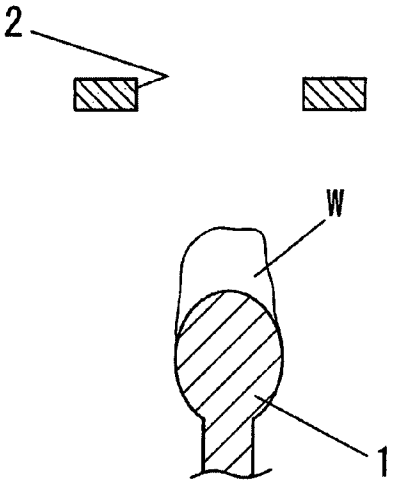
Figure 5C:
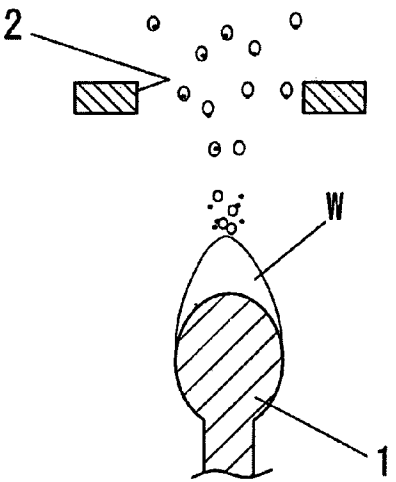
Figure 5D:
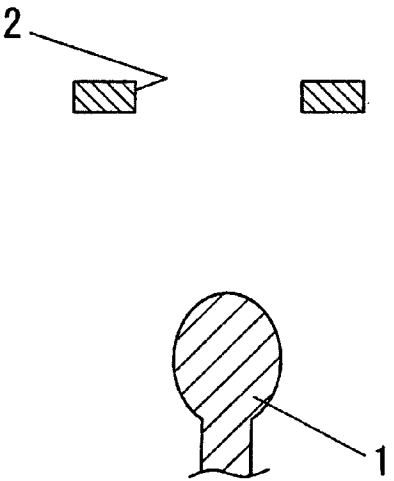

In response to termination of the freezing process, i.e., just after ice I is attached onto the atomizing electrode 1 as shown in FIG. 5A, a current is supplied to the heater 8 to start the melting process of melting the ice I frozen on the atomizing electrode 1 into water W, as shown in FIG. 5B. Then, in response to termination of the melting process, i.e., just after the ice I is melted into the water W, the electrostatic atomization process is started to apply a high voltage between the atomizing electrode 1 and the counter electrode 2, while continuing the current supply to the heater 8. Specifically, when the high-voltage applying section 5 is activated to apply a high voltage between the atomizing electrode 1 and the counter electrode 2, a Coulomb force acts between the counter electrode 2 and the water W supplied onto the tip end of the atomizing electrode 1, according to the high voltage applied between the atomizing electrode 1 and the counter electrode 2, to form a locally raised cone-shaped portion (Taylor cone) in a surface of the water W. Due to the formation of the Taylor cone, electric charges are concentrated at a tip of the Taylor cone to increase an electric field intensity and thereby increase the Coulomb force to be produced at the tip of the Taylor cone so as to accelerate growth of the Taylor cone. When electric charges are concentrated at the tip of the Taylor cone grown in this manner, to increase an electric charge density, large energy (repulsive force of the highly-desified electric charges) will be applied to a tip portion of the Taylor cone-shaped water at a level greater than a surface tension of the water, to cause repetitive breakup/scattering (Rayleigh breakup) of the water so as to produce a large number of nanometer-size charged fine water droplets, as shown in FIG. 5C. Along with the formation of the nanometer-size charged fine water droplets, the water W supplied onto the tip end of the atomizing electrode 1 will be gradually reduced. Then, just after the water W is fully consumed as shown in FIG. 5D, the high-voltage application and the current supply to the heater 8 are stopped to terminate the electrostatic atomization process. In response to the termination of the electrostatic atomization process, the freezing process is restarted. Subsequently, the series of processes, i.e., the freezing process for ice attachment, the melting process for water supply and the electrostatic atomization process, will be repeatedly performed in the same order and manner as those described above.

The nanometer-size charged fine water droplets produced in the above manner are released from the mist-releasing opening 17 formed in the front wall of the atomizer housing 31, into the mist-receiving space 9 through the center hole of the counter electrode 2.

Figure 6:
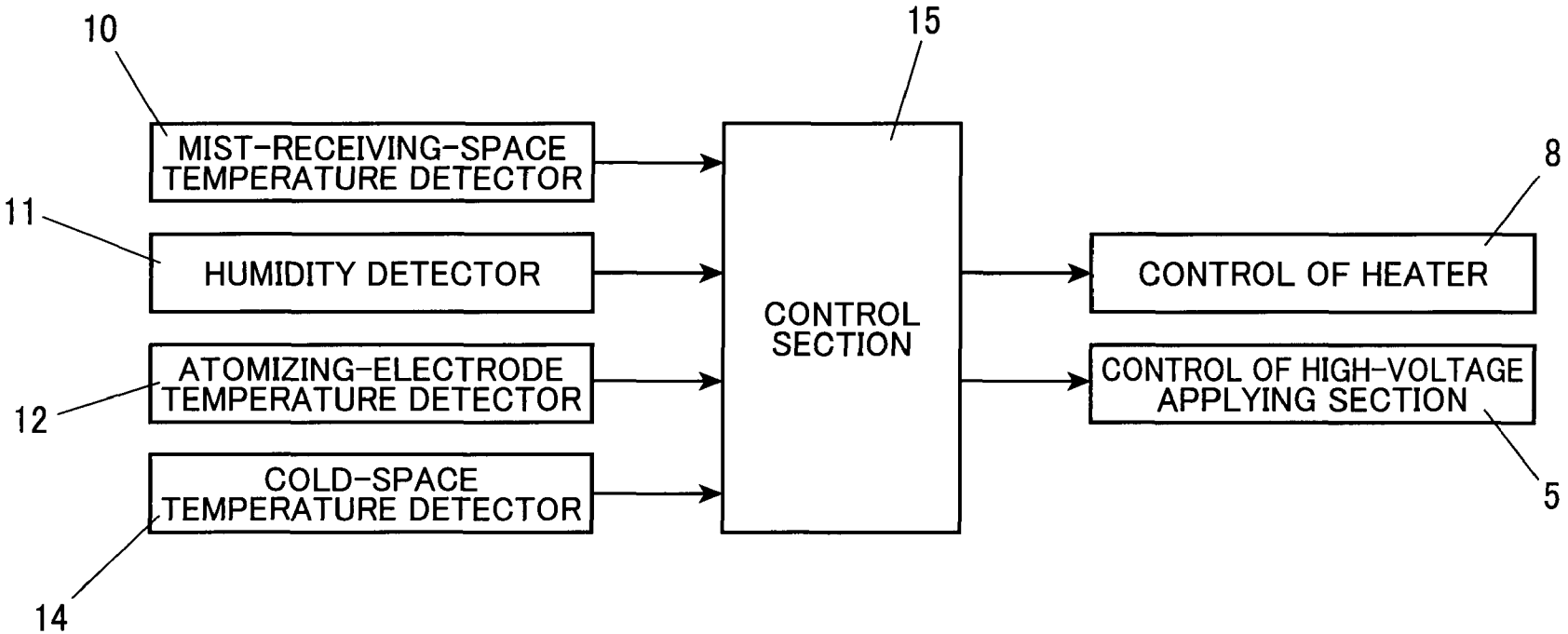
FIG. 6 is a block diagram showing a control system of the electrostatic atomizer shown in FIG. 1.

As shown in FIG. 6, the electrostatic atomizer according to the first embodiment further includes a mist-receiving-space temperature detector 10 adapted to detect a temperature of a mist-receiving space 9 targeted for implementation of the electrostatic atomization therewithin, a humidity detector 11 adapted to detect a humidity of the mist-receiving space 9, an atomizing-electrode temperature detector 12 adapted to detect a temperature of the atomizing electrode 1, and a cold-space temperature detector 14 adapted to detect a temperature of the cold space 13. The control section 15 is operable, based on detection data about temperature and humidity detected by the above detectors 10, 11, 12, 14, to control a start timing of the current supply to the heater 8 serving as the melter 4 (a start timing of melting ice), a stop timing of the current supply to the melter 4, a start timing of the high-voltage application, and a stop timing of the high-voltage application.

More specifically, the control section 15 is operable, based on detection data about a temperature of a mist-receiving space 9 targeted for implementation of the electrostatic atomization therewithin, a humidity of the mist-receiving space 9, a temperature of the atomizing electrode 1, and a temperature of the cold space 13, to control the melter 4 and the high-voltage applying section 5 in such a manner that the melting process of melting ice frozen on the atomizing electrode 1 is started at an optimal timing, and the electrostatic atomization process is started at an optimal timing just after the ice is fully melted and then terminated at an optimal timing just after water on the atomizing electrode 1 is fully consumed through the electrostatic atomization process. This makes it possible to efficiently perform the electrostatic atomization process without occurrence of undesirable situations where: the electrostatic atomization process is performed under a condition that a part of the ice is maintained without melting; the high-voltage application is started after an elapse of an unproductive waiting time from the completion of the melting of the ice, i.e., water supply; and the high-voltage is continuously applied even after the water is fully consumed.

The first embodiment has been described based on one example where the mist-receiving-space temperature detector 10, the humidity detector 11, the atomizing-electrode temperature detector 12 and the cold-space temperature detector 14 are provided, and the controller 15 is operable, based on detection data about temperature and humidity detected by the detectors 10, 11, 12, 14, to control the melter 4 and the high-voltage applying section 5 in such a manner that the melting process of melting ice frozen on the atomizing electrode 1 is started at an optimal timing, and the electrostatic atomization process is started at an optimal timing just after the ice is fully melted and then terminated at an optimal timing just after water on the atomizing electrode 1 is fully consumed through the electrostatic atomization process. Alternatively, at least one or more of the mist-receiving-space temperature detector 10, the humidity detector 11, the atomizing-electrode temperature detector 12 and the cold-space temperature detector 14 may be provided, and the controller 15 may be operable, based on detection data from one or more of the detectors, to control the melter 4 and the high-voltage applying section 5 in such a manner that the melting process of melting ice frozen on the atomizing electrode 1 is started at an optimal timing, and the electrostatic atomization process is started at an optimal timing just after the ice is fully melted and then terminated at an optimal timing just after water on the atomizing electrode 1 is fully consumed through the electrostatic atomization process. This also makes it possible to efficiently perform the electrostatic atomization process without occurrence of undesirable situations where: the electrostatic atomization process is performed under a condition that a part of the ice is maintained without melting; the high-voltage application is started after an elapse of an unproductive waiting time from the completion of the melting of the ice, i.e., water supply; and the high-voltage is continuously applied even after the water is fully consumed.

Figure 7:
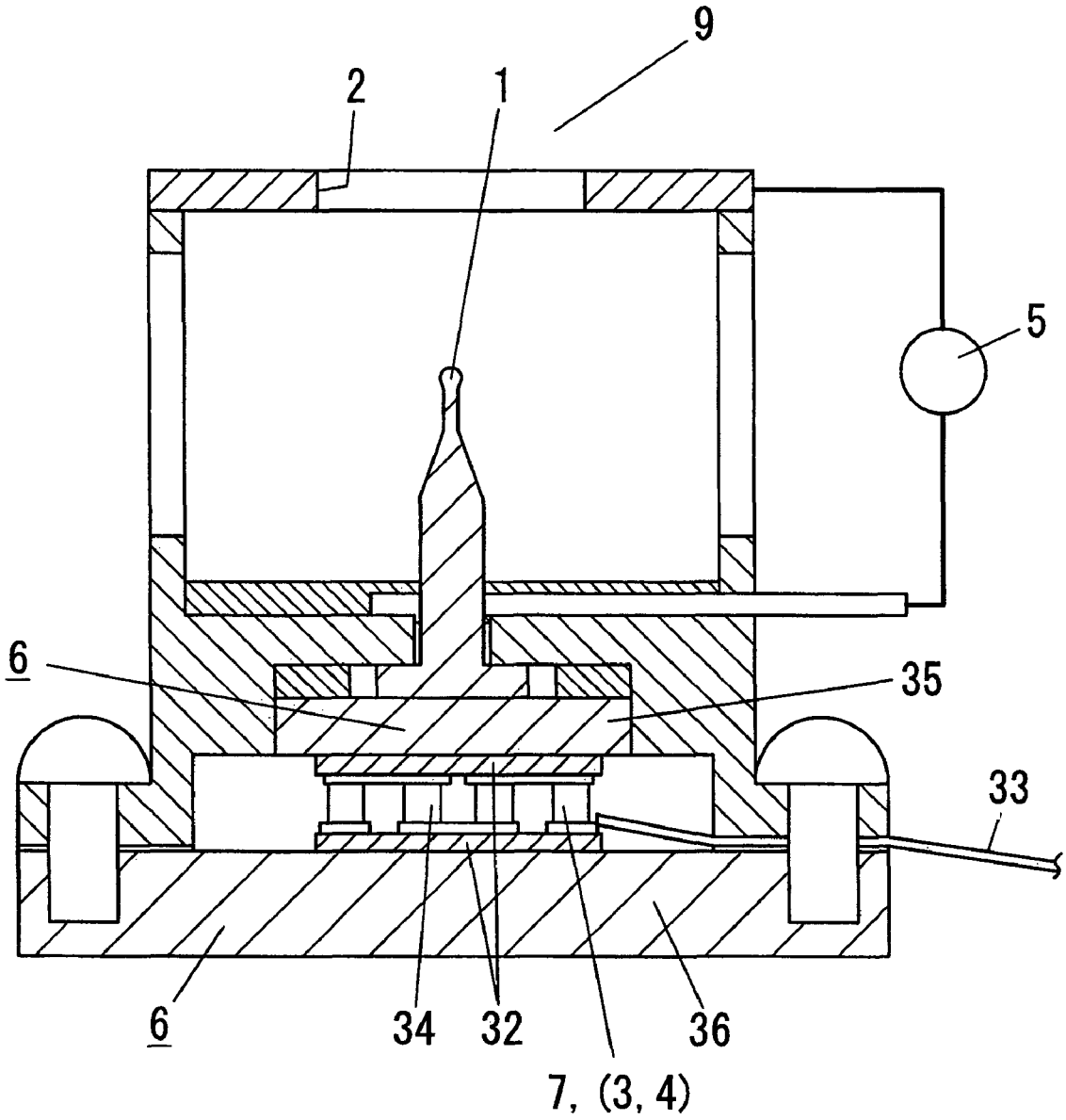
FIG. 7 is a schematic diagram view showing an electrostatic atomizer according to another embodiment of the present invention.
Figure 8:
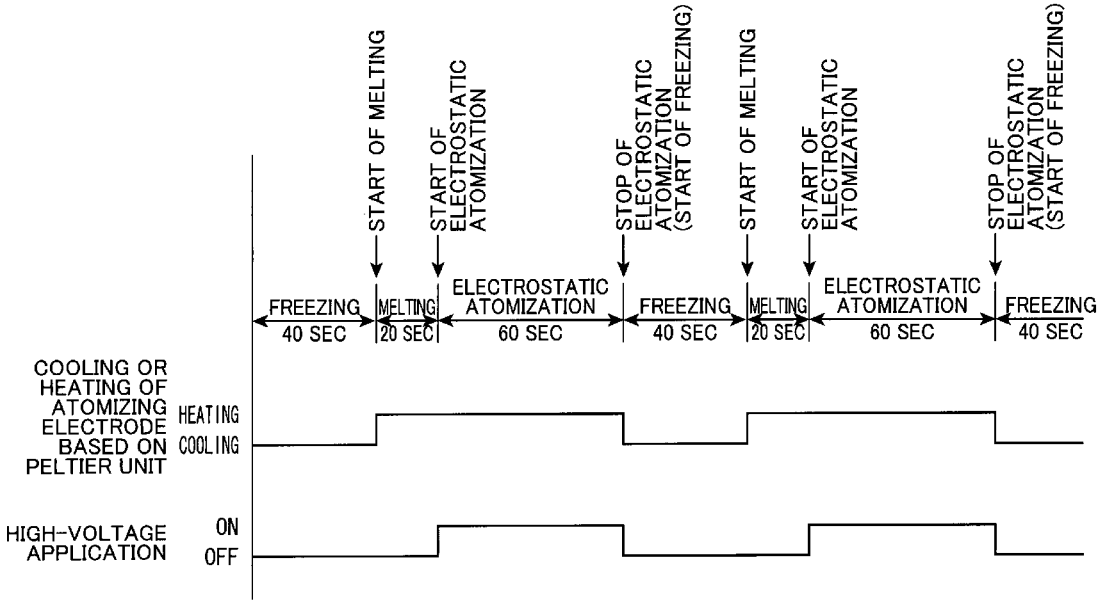
FIG. 8 is a time chart showing a control operation of the electrostatic atomizer shown in FIG. 7.
Figure 9:
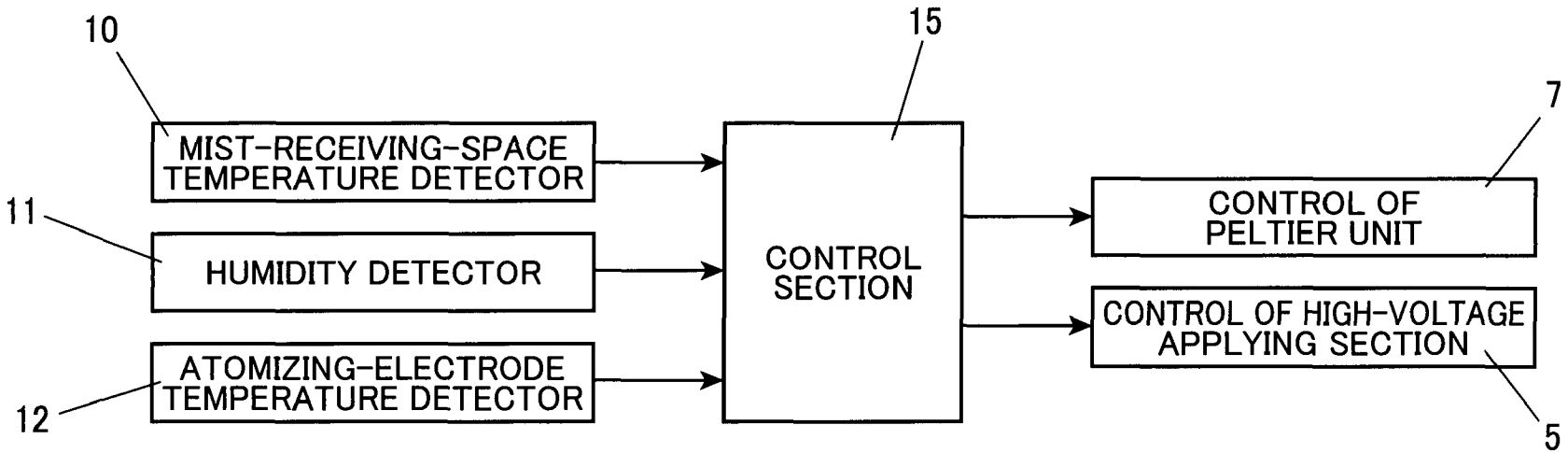
FIG. 9 is a block diagram showing a control system of the electrostatic atomizer shown in FIG. 7.

With reference to FIGS. 7 to 9, a second embodiment of the present invention will be described below. In the second embodiment, the cooler 3 and the melter 4 are made up of a Peltier unit 7.

The Peltier unit 7 comprises a pair of upper and lower Peltier circuit boards 32, and a thermoelectric device 34. Each of the upper and lower Peltier circuit boards 32 is prepared by forming a circuit on one surface of an electrical insulation substrate made of a material having high heat conductivity, such as alumina or aluminum nitride. The upper and lower Peltier circuit boards 32 are disposed to allow the respective circuits to be located in opposed relation to each other. The thermoelectric device 34 includes a large number of n-type and p-type BiTe-based thermoelectric elements 34 which are disposed in alternate arrangement and sandwiched between the upper and lower Peltier circuit boards 32, in such a manner that respective one ends of the adjacent n-type and p-type BiTe-based thermoelectric elements 34 are electrically connected in series through a corresponding one of the opposed circuits. The Peltier unit 7 is adapted, in response to supplying a current to the thermoelectric elements 34 through a Peltier input lead wire 33, to transfer heat from the side of one of the Peltier circuit boards 32 toward the other Peltier circuit board 32. The upper Peltier circuit boards 32 has an upper surface thermally connected to an upper electrical insulation plate 35 made of a material having high heat conductivity and high electric resistance, such as alumina or aluminum nitride. Further, the lower Peltier circuit board 32 has a lower surface thermally connected to a lower electrical insulation plate 36 made of a material having high heat conductivity and high electric resistance, such as alumina or aluminum nitride.

The upper Peltier circuit board 32 and the upper electrical insulation plate 35 serve as a first heat transfer section 6, and the lower Peltier circuit board 32 and the lower heat transfer plate 36 serve as a second heat transfer section 6, wherein heat is transferred from the side of one of the heat transfer sections 6 toward the other heat transfer section 6 through the thermoelectric elements 34.

In the second embodiment, one of the first and second heat transfer sections 6 (specifically, first heat transfer section 6) of the Peltier unit 7 is thermally connected to the atomizing electrode 1. Thus, when a current is supplied to the Peltier unit 7 in a first direction in such a manner as to cool the first heat transfer section 6, the atomizing electrode 1 thermally connected to the first heat transfer section 6 will be cooled down to 0 (zero)° C. or less to allow moisture in air of the mist-receiving space to be frozen and attached onto the atomizing electrode 1 in the form of ice I. In this case, the Peltier unit 7 serves as the cooler 3 adapted to cool the atomizing electrode 1 down to 0° C. or less.

Differently, when a current is supplied to the Peltier unit 7 in a second direction reverse to the first direction, the first heat transfer section 6 thermally connected to the atomizing electrode 1 becomes a heat release section. Thus, the atomizing electrode 1 will be heated up to a temperature of greater than 0° C. to allow the ice I attached on the atomizing electrode 1 to be melted so as to supply water onto the atomizing electrode 1. In this case, the Peltier unit 7 serves the melter 4 adapted to melt ice I attached on the atomizing electrode 1.

A control section 15 (see FIG. 9) is adapted to control a start timing and a time period of an operation of supplying a current to the Peltier unit 7 in the first direction to allow the Peltier unit 7 to serve as the cooler 3 so as to cool the atomizing electrode 1, a start timing and a time period of an operation of reversing the direction of current supply to the Peltier unit 7 (i.e., supplying a current to the Peltier unit 7 in the second direction reverse to the first direction) to allow the Peltier unit 7 to serve as the melter 4 so as to melt ice I frozen on the atomizing electrode 1, and a start timing and a time period of an operation of activating the high-voltage applying section to apply a high voltage between the atomizing electrode 1 and the counter electrode 2.

Specifically, in the second embodiment, as shown in the time chart illustrated in FIG. 8, the control section 15 is operable to control the current supply to the Peltier unit 7 and the high-voltage application, in such a manner as to repeatedly perform a freezing process of supplying a current to the Peltier unit 7 in a first direction to cool the atomizing electrode 1 down to 0 (zero)° C. or less, without the high-voltage application, a melting process of reversing the direction of current supply to the Peltier unit 7 (i.e., supplying a current to the Peltier unit 7 in a second direction reverse to the first direction) after termination of the freezing process, to heat the atomizing electrode 1 (without the high-voltage application), and an electrostatic atomization process of applying a high voltage after termination of the melting process (during the electrostatic atomization process, the heating of the atomizing electrode 1 is continued by successively supplying a current to the Peltier unit 7 in the second direction), in sequence.

In one example illustrated in FIG. 8, the timing of switching between the first and second directions of current supply to the Peltier unit 7, the time period of current supply in each of the processes, and the start timing and time period of activating the high-voltage applying section to apply a high voltage between the atomizing electrode 1 and the counter electrode 2, are controlled to allow respective time periods of the freezing process, the melting process and the electrostatic atomization process to be set at 30 seconds, 20 seconds and 60 seconds, respectively. The specific time periods of the above processes are shown only by way of example, and each of the time periods may be set at an optimal value in consideration of a temperature and a humidity of the mist-receiving space 9, desired cooling and heating temperatures of the atomizing electrode 1 to be cooled or heated by the Peltier unit 7 and other parameter.

In the above control operation illustrated in FIG. 8, in the freezing period, the atomizing electrode 1 is cooled down to 0 (zero)° C. or less by the Peltier unit 7, so that moisture in air of the mist-receiving space 9 is frozen and attached onto the atomizing electrode in the form of ice I, as shown in FIG. 5A.

In response to termination of the freezing process, i.e., just after ice I is attached onto the atomizing electrode 1 as shown in FIG. 5A, the direction of current supply to the Peltier unit 7 is reversed to start the melting process of heating the atomizing electrode 1 to melt the ice I frozen on the atomizing electrode 1 into water W, as shown in FIG. 5B. Then, in response to termination of the melting process, i.e., just after the ice I is melted into the water W, the electrostatic atomization process is started to apply a high voltage between the atomizing electrode 1 and the counter electrode 2, while continuing to heat the atomizing electrode 1 by successively supplying a current to the Peltier unit 7 in the second direction. Specifically, when the high-voltage applying section 5 is activated to apply a high voltage between the atomizing electrode 1 and the counter electrode 2, a Coulomb force acts between the counter electrode 2 and the water W supplied onto the tip end of the atomizing electrode 1, according to the high voltage applied between the atomizing electrode 1 and the counter electrode 2, to form a locally raised cone-shaped portion (Taylor cone) in a surface of the water W. Due to the formation of the Taylor cone, electric charges are concentrated at a tip of the Taylor cone to increase an electric field intensity and thereby increase the Coulomb force to be produced at the tip of the Taylor cone so as to accelerate growth of the Taylor cone. When electric charges are concentrated at the tip of the Taylor cone grown in this manner, to increase an electric charge density, large energy (repulsive force of the highly-desified electric charges) will be applied to a tip portion of the Taylor cone-shaped water at a level greater than a surface tension of the water, to cause repetitive breakup/scattering (Rayleigh breakup) of the water so as to produce a large number of nanometer-size charged fine water droplets, as shown in FIG. 5C. Along with the formation of the nanometer-size charged fine water droplets, the water W supplied onto the tip end of the atomizing electrode 1 will be gradually reduced. Then, just after the water W is fully consumed as shown in FIG. 5D, the electrostatic atomization process is terminated. At a time of the termination of the electrostatic atomization process, the high-voltage application is stopped, and a current is supplied to the Peltier unit 7 in the first direction to restart the freezing process of cooling the atomizing electrode 1 down to 0° C. or less. Subsequently, the series of processes, i.e., the freezing process for ice attachment, the melting process for water supply and the electrostatic atomization process, will be repeatedly performed in the same order and manner as those described above.

The nanometer-size charged fine water droplets produced in the above manner are released from the mist-releasing opening 17 formed in the front wall of the atomizer housing 31, into the mist-receiving space 9 through the center hole of the counter electrode 2.

As shown in FIG. 9, the electrostatic atomizer according to the second embodiment further includes a mist-receiving-space temperature detector 10 adapted to detect a temperature of a mist-receiving space 9 targeted for implementation of the electrostatic atomization therewithin, a humidity detector 11 adapted to detect a humidity of the mist-receiving space 9, and an atomizing-electrode temperature detector 12 adapted to detect a temperature of the atomizing electrode 1. The control section 15 is operable, based on detection data about temperature and humidity detected by the above detectors 10, 11, 12, to control a start timing of the melting based on a melter 4, a start timing of the electrostatic atomization based on activation of the high-voltage applying section 5, and a stop timing of the electrostatic atomization based on deactivation of the high-voltage applying section 5.

More specifically, the control section 15 is operable, based on detection data about a temperature of a mist-receiving space 9 targeted for implementation of the electrostatic atomization therewithin, a humidity of the mist-receiving space 9, and a temperature of the atomizing electrode 1, to control a start timing of supplying a current to the Peltier unit 7 in the second direction to allow the Peltier unit 7 to serve as the melter 4 so as to heat the atomizing electrode 1, a timing of switching the direction of current supply to the Peltier unit 7 to the first direction so as to restart to cool the atomizing electrode 1, a start timing of the electrostatic atomization based on activation of the high-voltage applying section 5, and a stop timing of the electrostatic atomization based on deactivation of the high-voltage applying section 5. This makes it possible to controllably set the time period of current supply at an optimal value which allows ice frozen on the atomizing electrode 1 to be adequately melted, so as to efficiently perform the electrostatic atomization process, without occurrence of undesirable situations where: the electrostatic atomization process is performed under a condition that a part of the ice is maintained without melting; the high-voltage application is started after an elapse of an unproductive waiting time from the completion of the melting of the ice, i.e., water supply; and the high-voltage is continuously applied even after the water is fully consumed.

The second embodiment has been described based on one example where the mist-receiving-space temperature detector 10, the humidity detector 11 and the atomizing-electrode temperature detector 12 are provided, and the controller 15 is operable, based on detection data about temperature and humidity detected by the detectors 10, 11, 12, to control a start timing of supplying a current to the Peltier unit 7 in the second direction so as to heat the atomizing electrode 1, a timing of switching the direction of current supply to the Peltier unit 7 to the first direction so as to restart to cool the atomizing electrode 1, a start timing of the electrostatic atomization based on activation of the high-voltage applying section 5, and a stop timing of the electrostatic atomization based on deactivation of the high-voltage applying section 5. Alternatively, at least one or more of the mist-receiving-space temperature detector 10, the humidity detector 11 and the atomizing-electrode temperature detector 12 may be provided, and the controller 15 may be operable, based on detection data from one or more of the detectors, to control a start timing of supplying a current to the Peltier unit 7 in the second direction to allow the Peltier unit 7 to serve as the melter 4 so as to heat the atomizing electrode 1, a timing of switching the direction of current supply to the Peltier unit 7 to the first direction so as to restart to cool the atomizing electrode 1, a start timing of the electrostatic atomization based on activation of the high-voltage applying section 5, and a stop timing of the electrostatic atomization based on deactivation of the high-voltage applying section 5. This also makes it possible to efficiently perform the electrostatic atomization process without occurrence of undesirable situations where: the electrostatic atomization process is performed under a condition that a part of the ice is maintained without melting; the high-voltage application is started after an elapse of an unproductive waiting time from the completion of the melting of the ice, i.e., water supply; and the high-voltage is continuously applied even after the water is fully consumed.

In the above embodiments, the nanometer-size charged water droplets generated and released to the mist-receiving space 9 are as small as a manometer in size and thereby exhibit long-time floatability on air and high dispersion performance. Thus, the nanometer-size charged water droplets can drift in every corner of the mist-receiving space 9 and attach on an inner wall of a structural member defining the mist-receiving space 9 and an article stored in the mist-receiving space 9. In addition, the nanometer-size charged water droplets contain active species having a deodorizing effect, a sterilization effect on molds and bacteria, and a suppressive effect on propagation thereof, wherein the active species exist therein in a state of being wrapped with water molecules. Thus, when the nanometer-size charged water droplets attach on an inner wall of a structural member defining the mist-receiving space 9 and an article stored in the mist-receiving space 9, they will bring out a deodorizing effect, a sterilization effect on molds and bacteria, and a suppressive effect on propagation thereof. Further, the active species existing in the nanometer-size charged water droplets in the state of being wrapped with water molecules exhibit a longer life as compared with active species existing independently in the form of a free radical, and thereby provide enhanced dispersion performance, deodorizing effect, sterilization effect on molds and bacteria, and suppressive effect on propagation thereof. As might be expected, the nanometer-size charged water droplets also have a moisturizing effect to moisturize an article stored in the mist-receiving space 9.

In the above embodiments, the cooler 3 is operable to cool the atomizing electrode 1 down to 0 (zero)° C. or less so as to allow moisture in air to be frozen and attached onto the atomizing electrode 1, and then the melter 4 is operable to melt ice frozen and attached on the atomizing electrode 1 so as to supply water onto the atomizing electrode 1. Thus, even if a mist-receiving space 9 targeted for implementation of electrostatic atomization therewithin has a low temperature and/or a low humidity, the cooler 3 can lower a temperature of the atomizing electrode 1 down to a saturation temperature of moisture in air of the mist-receiving space 9 (i.e., down to any temperature of 0° C. or less), to allow the moisture in air of the mist-receiving space 9 to be reliably frozen and attached onto the atomizing electrode 1 in the form of ice I, and then the melter can melt the ice I attached on the atomizing electrode 1 and supply water W onto the atomizing electrode 1. This makes it possible to reliably supply water onto the atomizing electrode 1 and electrostatically atomize the water in a stable manner.

In the above embodiments, moisture in air is frozen, and then ice is melted and supplied in the form of water. That is, in the above embodiments, a setup temperature of the atomizing electrode 1, i.e., a temperature of the atomizing electrode 1 required for freezing moisture in air of the mist-receiving space into ice, is 0° C. or less. This means that an atomizable zone in the electrostatic atomizers according to the above embodiments is defined as an entire zone located above a curve for a certain setup temperature of 0° C. or less, in the graph of FIG. 10. This makes it possible to fairly broaden the atomizable zone as compared with an atomizable zone in the conventional electrostatic atomizer which is located above a curve for a certain setup temperature of greater than 0° C., in FIG. 10, i.e., to broaden temperature/humidity environments allowing for utilization of the electrostatic atomizer.

Figure 10:
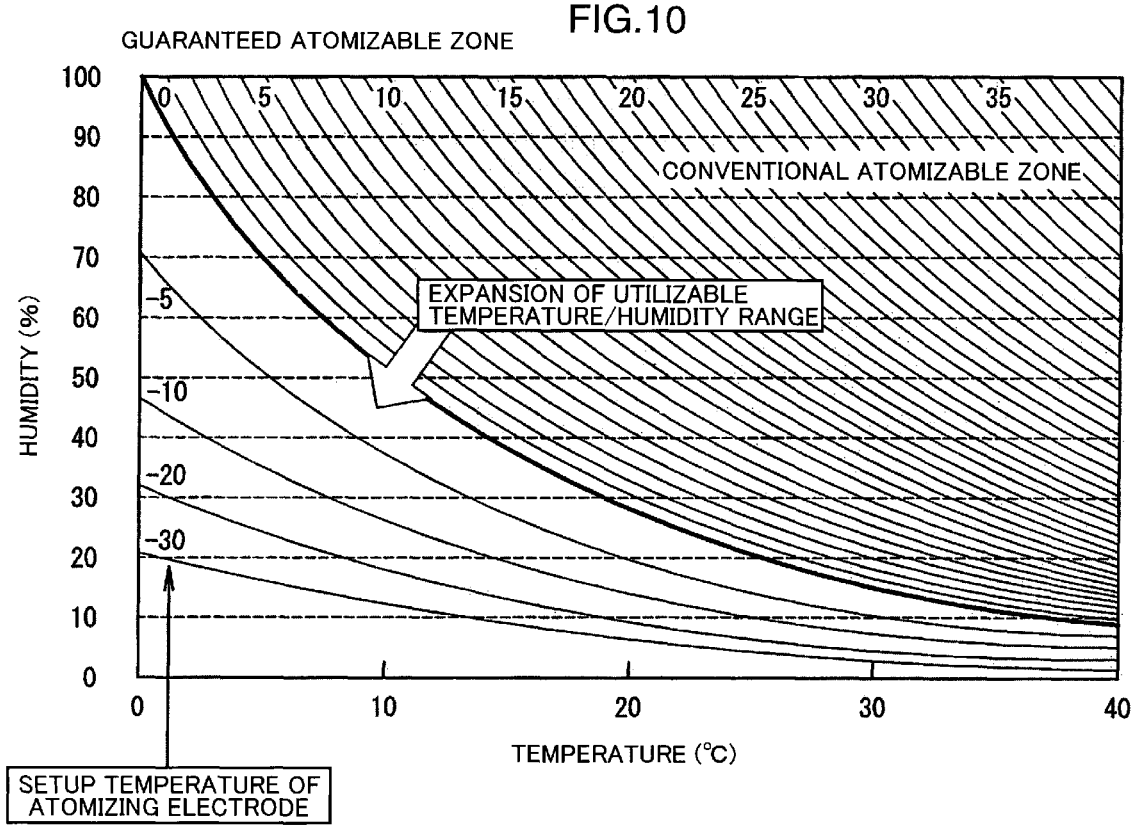
FIG. 10 is a graph showing an atomizable zone determined by a relationship of a temperature of a mist-receiving space, a humidity of the mist-receiving space and a setup temperature of an atomizing electrode.

For example, when the atomizing electrode 1 is cooled to have a setup temperature of −5° C., an atomizable zone is defined as an entire zone located above the curve for −5° C. in FIG. 10. When the atomizing electrode 1 is cooled to have a setup temperature of −20° C., an atomizable zone is defined as an entire zone located above the curve for −20° C. in FIG. 10. When the atomizing electrode 1 is cooled to have a setup temperature of −25° C., an atomizable zone is defined as an entire zone located above the curve for −25° C. in FIG. 10.

It is understood that the setup temperature of the atomizing electrode 1 may be set at any value of 0° C. or less, which allows moisture in air of the mist-receiving space 9 to be frozen and attached onto the atomizing electrode 1 in the form of ice.

The first and second embodiments have been described based on one example where the heating of the atomizing electrode 1 based on the melter 4 is stopped simultaneously with the termination of the electrostatic atomization process, i.e., the stop of the high-voltage application. Alternatively, the heating of the atomizing electrode 1 based on the melter 4 may be stopped simultaneously with the start of the electrostatic atomization process, i.e., the start of the high-voltage application, or may be stopped at any time between the start of the high-voltage application and the stop of the high-voltage application. This makes it possible to reduce a time period of activating the melter 4 so as to facilitate energy saving. When this control is performed in an embodiment using the Peltier unit 7, the current supply to the Peltier unit 7 may be stopped at the above timing to stop heating the atomizing electrode 1, and then may be restarted simultaneously with the stop of the high-voltage application, in such a manner as to cool the atomizing electrode 1.

As described above, an electrostatic atomizer comprises an atomizing electrode adapted to be controlled to electrostatically atomize water attached thereon, a cooler adapted to cool the atomizing electrode so as to allow moisture in air to be frozen onto the atomizing electrode, a melter adapted to melt ice frozen on the atomizing electrode so as to supply water onto the atomizing electrode, a high-voltage applying section adapted to apply a high voltage to the atomizing electrode, and a control section adapted to activate the high-voltage applying section in a state after supplying water onto the atomizing electrode by melting the ice frozen thereon, so as to induce electrostatic atomization of the water.

In the electrostatic atomizer, the cooler is operable to cool the atomizing electrode down to 0 (zero)° C. or less so as to allow moisture in air to be frozen and attached onto the atomizing electrode in the form of ice, and then the melter is operable to melt the ice frozen and attached on the atomizing electrode so as to supply the melted water onto the atomizing electrode. Then, the high-voltage applying section is operable to apply a high voltage to the atomizing electrode so as to induce electrostatic atomization of the water supplied onto the atomizing electrode. In this manner, moisture in air is frozen into ice once, and then the ice is melted and supplied in the form of water. Thus, even if a mist-receiving space targeted for implementation of electrostatic atomization therewithin has a low humidity and/or a low temperature, water can be reliably supplied onto the atomizing electrode and electrostatically atomized to stably produce charged fine water droplets. This makes it possible to effectively expand an atomizable zone so as to utilize the electrostatic atomizer in a broader range of humidity/temperature environments.

Preferably, in the electrostatic atomizer, the cooler and the melter may comprise a Peltier unit having two heat transfer sections adapted such that, when either one of the heat transfer sections serves as a cooling section, the other heat transfer section serves as a heating section, wherein either one of the heat transfer sections is thermally connected to the atomizing electrode, and the Peltier unit is adapted to be applied with a current in such a manner that a direction of the current is switched to selectively cool and heat the atomizing electrode.

According to this feature, a current is supplied to the Peltier unit in a first direction to cool the atomizing electrode down to 0 (zero)° C. or less so as to allow moisture in air to be frozen and attached onto the atomizing electrode in the form of ice, and then the direction of current supply to the Peltier unit is switched to a second direction to heat the atomizing electrode and melt the ice frozen and attached on the atomizing electrode so as to supply water onto the atomizing electrode. Thus, the cooler and the melter can be made up of a simple structure designed to switch between the two directions of current supply to the Peltier unit.

Alternatively, the melter may comprise an electric heater.

In this case, ice frozen and attached on the atomizing electrode can be heated by the heater to readily supply water onto the atomizing electrode so as to facilitate structural simplification.

Preferably, the electrostatic atomizer may include a mist-receiving-space temperature detector adapted to detect a temperature of a mist-receiving space targeted for implementation of the electrostatic atomization therewithin. The control section is operable, based on data about the mist-receiving-space temperature detected by the mist-receiving-space temperature detector, to control a start timing of the melting based on the melter, a start timing of the electrostatic atomization based on activation of the high-voltage applying section, and a stop timing of the electrostatic atomization based on deactivation of the high-voltage applying section.

According to this feature, the melter and the high-voltage applying section can be controlled depending on a temperature of the mist-receiving space in such a manner that a melting process of melting ice frozen on the atomizing electrode is started at an optimal timing, and an electrostatic atomization process is started at an optimal timing just after the ice is fully melted and then terminated at an optimal timing just after water on the atomizing electrode is fully consumed through the electrostatic atomization process. This makes it possible to efficiently perform the electrostatic atomization process without occurrence of undesirable situations where: the electrostatic atomization process is performed under a condition that a part of the ice is maintained without melting; the high-voltage application is started after an elapse of an unproductive waiting time from the completion of the melting of the ice, i.e., water supply; and the high-voltage is continuously applied even after the water is fully consumed.

Preferably, the electrostatic atomizer may include a humidity detector adapted to detect a humidity of a mist-receiving space targeted for implementation of the electrostatic atomization therewithin. The control section is operable, based on data about the mist-receiving-space humidity detected by the humidity detector, to control a start timing of the melting based on the melter, a start timing of the electrostatic atomization based on activation of the high-voltage applying section, and a stop timing of the electrostatic atomization based on deactivation of the high-voltage applying section.

According to this feature, the melter and the high-voltage applying section can be controlled depending on a humidity of the mist-receiving space in such a manner that a melting process of melting ice frozen on the atomizing electrode is started at an optimal timing, and an electrostatic atomization process is started at an optimal timing just after the ice is fully melted and then terminated at an optimal timing just after water on the atomizing electrode is fully consumed through the electrostatic atomization process. This makes it possible to efficiently perform the electrostatic atomization process without occurrence of undesirable situations where: the electrostatic atomization process is performed under a condition that a part of the ice is maintained without melting; the high-voltage application is started after an elapse of an unproductive waiting time from the completion of the melting of the ice, i.e., water supply; and the high-voltage is continuously applied even after the water is fully consumed.

Preferably, the electrostatic atomizer may include an atomizing-electrode temperature detector adapted to detect a temperature of the atomizing electrode. The control section is operable, based on data about the atomizing-electrode temperature detected by the atomizing-electrode temperature detector, to control a start timing of the melting based on the melter, a start timing of the electrostatic atomization based on activation of the high-voltage applying section, and a stop timing of the electrostatic atomization based on deactivation of the high-voltage applying section.

According to this feature, the melter and the high-voltage applying section can be controlled depending on a temperature of the atomizing electrode in such a manner that a melting process of melting ice frozen on the atomizing electrode is started at an optimal timing, and an electrostatic atomization process is started at an optimal timing just after the ice is fully melted and then terminated at an optimal timing just after water on the atomizing electrode is fully consumed through the electrostatic atomization process. This makes it possible to efficiently perform the electrostatic atomization process without occurrence of undesirable situations where: the electrostatic atomization process is performed under a condition that a part of the ice is maintained without melting; the high-voltage application is started after an elapse of an unproductive waiting time from the completion of the melting of the ice, i.e., water supply; and the high-voltage is continuously applied even after the water is fully consumed.

Preferably, the electrostatic atomizer may include a cold-space temperature detector adapted to detect a temperature of a cold space which is located in adjacent relation to a mist-receiving space targeted for implementation of the electrostatic atomization therewithin, and maintained at a temperature less than that of the mist-receiving space. The cooler is operable to cool the atomizing electrode through heat exchange with the cold space so as to allow moisture in air to be frozen onto the atomizing electrode, and the control section is operable, based on data about the cold-space temperature detected by the cold-space temperature detector, to control a start timing of the melting based on the melter, a start timing of the electrostatic atomization based on activation of the high-voltage applying section, and a stop timing of the electrostatic atomization based on deactivation of the high-voltage applying section.

Depending on a change in temperature of the cold space, a cooling temperature of the atomizing electrode is changed, and thereby an amount of ice to be formed by freezing moisture in air of the mist-receiving space onto the atomizing electrode is changed. Thus, according to this feature, the melter and the high-voltage applying section can be controlled depending on a temperature of the cold space in such a manner that a melting process of melting ice frozen on the atomizing electrode is started at an optimal timing, and an electrostatic atomization process is started at an optimal timing just after the ice is fully melted and then terminated at an optimal timing just after water on the atomizing electrode is fully consumed through the electrostatic atomization process. This makes it possible to efficiently perform the electrostatic atomization process without occurrence of undesirable situations where: the electrostatic atomization process is performed under a condition that a part of the ice is maintained without melting; the high-voltage application is started after an elapse of an unproductive waiting time from the completion of the melting of the ice, i.e., water supply; and the high-voltage is continuously applied even after the water is fully consumed.

In this description, an element or component described in the form of means for achieving a certain function is not limited to a specific structure, configuration or arrangement disclosed in the specification to achieve such a function, but may include any other suitable structure, configuration or arrangement, such as a unit, a mechanism or a component, capable of achieving such a function.

Industrial Applicability

In an inventive electrostatic atomizer, a cooler is operable to cool an atomizing electrode so as to allow moisture in air to be frozen onto the atomizing electrode, and then a melter is operable to melt ice frozen on the atomizing electrode so as to supply water onto the atomizing electrode. Then, a control section is operable to activate a high-voltage applying section in a state after supplying water onto the atomizing electrode by melting the ice frozen thereon, so as to induce electrostatic atomization of the water. Thus, water can be reliably supplied onto the atomizing electrode and electrostatically atomized, without restrictions due to temperature/humidity conditions in a mist-receiving space targeted for implementation of electrostatic atomization therewithin, even if the mist-receiving space has a low temperature and/or a low humidity.

The invention claimed is:

1. An electrostatic atomizer for use in a space system formed with a mist-receiving space and a cold space having a temperature lower than a temperature of the mist-receiving space by a partition section, comprising:

an atomizing electrode adapted to be controlled to electrostatically atomize water attached thereon;

a cooler adapted to cool said atomizing electrode so as to allow moisture in air to be frozen onto said atomizing electrode;

a melter adapted to melt ice frozen on said atomizing electrode so as to supply water onto said atomizing electrode;

a high-voltage applying section adapted to apply a high voltage to said atomizing electrode; and a control section adapted to activate said high-voltage applying section in a state after supplying water onto said atomizing electrode by melting said ice frozen thereon, so as to induce electrostatic atomization of said water, wherein said cooler is operable to cool said atomizing electrode through heat exchange with said cold space so as to allow moisture in air to be frozen onto said atomizing electrode.

2. The electrostatic atomizer as defined in claim 1, wherein said melter comprises an electric heater.

3. The electrostatic atomizer as defined in claim 1, further comprising:

the mist-receiving space temperature detector adapted to detect a temperature of a mist-receiving space targeted for implementation of the electrostatic atomization therewithin, wherein said control section is operable, based on data about the mist-receiving-space temperature detected by said mist-receiving-space temperature detector, to control a start timing of the melting based on said melter, a start timing of the electrostatic atomization based on activation of said high-voltage applying section, and a stop timing of said electrostatic atomization based on deactivation of said high-voltage applying section.

4. The electrostatic atomizer as defined in claim 1, further comprising:

a humidity detector adapted to detect a humidity of the mist-receiving space targeted for implementation of the electrostatic atomization therewithin, wherein said control section is operable, based on data about the mist-receiving-space humidity detected by said humidity detector, to control a start timing of the melting based on said melter, a start timing of the electrostatic atomization based on activation of said high-voltage applying section, and a stop timing of said electrostatic atomization based on deactivation of said high-voltage applying section.

5. The electrostatic atomizer as defined in claim 1, further comprising:

an atomizing-electrode temperature detector adapted to detect a temperature of said atomizing electrode, wherein said control section is operable, based on data about the atomizing-electrode temperature detected by said atomizing-electrode temperature detector, to control a start timing of the melting based on said melter, a start timing of the electrostatic atomization based on activation of said high-voltage applying section, and a stop timing of said electrostatic atomization based on deactivation of said high-voltage applying section.

6. The electrostatic atomizer as defined in claim 1, further comprising:

a cold-space temperature detector adapted to detect the temperature of said cold space, wherein said control section is operable, based on data about the cold-space temperature detected by said cold-space temperature detector, to control a start timing of the melting based on said melter, a start timing of the electrostatic atomization based on activation of said high-voltage applying section, and a stop timing of said electrostatic atomization based on deactivation of said high-voltage applying section.

7. The electrostatic atomizer as defined in claim 1, wherein said space system comprises a refrigerator.

* * * * *